US006053249A

United States Patent [19]

Stevenson et al.

[11] Patent Number: 6,053,249

[45] Date of Patent: Apr. 25, 2000

[54] METHOD AND APPARATUS FOR INJECTING GAS INTO A SUBTERRANEAN FORMATION

[75] Inventors: Mark D. Stevenson; Jerry L. Brady, both of Anchorage, Ak.

[73] Assignee: Atlantic Richfield Company, Los Angeles, Calif.

[21] Appl. No.: 09/072,657

[22] Filed: May 5, 1998

[51] Int. Cl.[7] ..... E21B 43/40; E21B 43/16

[52] U.S. Cl. ..... 166/305.1; 166/265; 405/128

[58] Field of Search ..... 166/90.1, 105.1, 166/265, 267, 268, 305.1; 405/53, 128

[56] References Cited

U.S. PATENT DOCUMENTS

| | | | |
|---|---|---|---|
| 4,074,763 | 2/1978 | Stevens | 166/325 |
| 4,481,020 | 11/1984 | Lee et al. | 55/203 |
| 4,531,584 | 7/1985 | Ward | 166/265 |
| 4,632,601 | 12/1986 | Kuwadd | 405/128 |
| 5,343,945 | 9/1994 | Weingarten et al. | 166/305.1 |
| 5,421,408 | 6/1995 | Stoisits et al. | 166/274 |
| 5,431,228 | 7/1995 | Weingarten et al. | 166/357 |
| 5,450,901 | 9/1995 | Ellwood | 166/266 |
| 5,482,117 | 1/1996 | Kolpak et al. | 166/265 |
| 5,570,744 | 11/1996 | Weingarten et al. | 166/357 |
| 5,698,014 | 12/1997 | Cadle et al. | 96/157 |

OTHER PUBLICATIONS

"New Design for Compact Liquid–Gas Partial Separation", J.S. Weingarten et al, SPE 30637, Dallas, TX Oct. 22–25, 1995. pp. 73–80.

*Primary Examiner*—David Bagnell
*Assistant Examiner*—Jennifer R. Dougherty
*Attorney, Agent, or Firm*—D. Faulconer

[57] ABSTRACT

A method and apparatus for injecting gas into a subterranean formation wherein the gas to be injected is mixed with a carrier fluid (e.g. water) at the surface to form a mixture which is then flowed down a wellbore. The mixture is flowed through a downhole separator to separate at least a portion of the gas from the mixture which is then injected into the formation. The carrier fluid and any unseparated gas are then returned to the surface to be separated whereby the carrier fluid can be recycled in the gas injection process.

18 Claims, 2 Drawing Sheets

METHOD AND APPARATUS FOR INJECTING GAS INTO A SUBTERRANEAN FORMATION

DESCRIPTION

1. Technical Field

The present invention relates to a method and apparatus for injecting gas into a subterranean formation and in one aspect relates to a method and apparatus for injecting gas into a formation wherein the gas is mixed with a carrier fluid at the surface which, in turn, is flowed down a well where at least a portion of the gas is separated and injected into the formation while the remaining gas and the carrier fluid is returned to the surface.

2. Background

It is well known that many hydrocarbon reservoirs produce extremely large volumes of gas along with crude oil and other liquids. In producing fields such as these, it is not unusual to experience gas-to-oil ratios (GOR) as high as 25,000 standard cubic feet per barrel (scf/bbl.) or greater. As a result, large volumes of gas must be separated out of the liquids before the liquids are transported to storage or for further processing. Where the production sites are near or convenient to large markets, this gas is considered a valuable asset when demands for gas are high. However, when demands are low or when the producing reservoir is located in a remote area, large volumes of produced gas can present major problems since production may have to shut-in or at least drastically reduced if the produced gas can not be timely and properly disposed of.

In areas where substantial volumes of the produced gas can not be marketed or otherwise utilized, it is common to "reinject" the gas into a suitable, subterranean formation. For example, it is well known to inject the gas back into a "gas cap" zone which usually overlies a production zone of a reservoir to maintain the pressure within the reservoir and thereby increase the ultimate liquid recovery therefrom. In other applications, the gas may be injected into a producing formation through an injection well to drive the hydrocarbons ahead of the gas towards a production well. Still further, the produced gas may be injected and "stored" in an appropriate, subterranean permeable formation from which it can be recovered when the situation dictates.

To reinject the gas, large and expensive separation and compression surface facilities must be built at or near the production site. A major economic consideration in such facilities is the relatively high costs of the gas compressor train which is needed to compress the large volumes of produced gas to the pressures required for injection. As will be understood in this art, significant cost savings can be achieved if the gas compressor requirements can be downsized or eliminated altogether. To achieve this, however, it is necessary to either raise the pressure at the surface by some means other than mechanical compression or else reduce the pressure required at the surface for injection of the gas downhole.

SUMMARY OF THE INVENTION

The present invention provides a method and apparatus for injecting gas into a subterranean formation in which the compressor horsepower required is substantially reduced or is eliminated altogether. Basically, the gas to be injected is mixed with a carrier fluid at the surface to form a mixture which is then flowed down a wellbore which extends into the subterranean formation. The mixture is flowed through a downhole separator to separate at least a portion of the gas from the mixture which is then injected into the formation. The carrier fluid and any unseparated gas is then returned to the surface wherein it is further separated whereby the carrier fluid can be recycled for reuse in the operation.

More specifically, the gas to be injected is mixed with a dense, carrier fluid at the surface which, in turn, has been boosted to a relatively high pressure by a liquid pump or the like. The carrier fluid can be selected from a wide variety of liquids, e.g. water, brine, oil-based liquids, crude, etc. The mixture is flowed down either a string of tubing in the wellbore or through the annulus formed between the tubing and the wellbore and through a downhole separator; e.g. auger separator. Centrifugal force separates at least a portion of the gas (e.g. 75%) and the downhole pressures force the separated gas into the subterranean formation. The mixture of the carrier fluid and any unseparated gas flow upward from the separator to the surface through either the annulus or the tubing as the case may be.

The mixture of carrier fluid and unseparated gas is passed through a separator after it returns to the surface to separate the gas from the carrier fluid whereby the carrier fluid can be recycled. By forming a mixture with a dense, carrier fluid, the gas does not need to be compressed at the surface before it is injected down the wellbore. As will be appreciated, by reducing or eliminating the need for gas compressors, the costs involved in disposing of excess gas through injection are substantially reduced.

BRIEF DESCRIPTION OF THE DRAWINGS

The actual construction, operation, and apparent advantages of the present invention will be better understood by referring to the drawings which are not necessarily to scale and in which like numerals refer to like parts and in which.

BEST KNOW MODE FOR CARRYING OUT THE INVENTION

Figure 1:
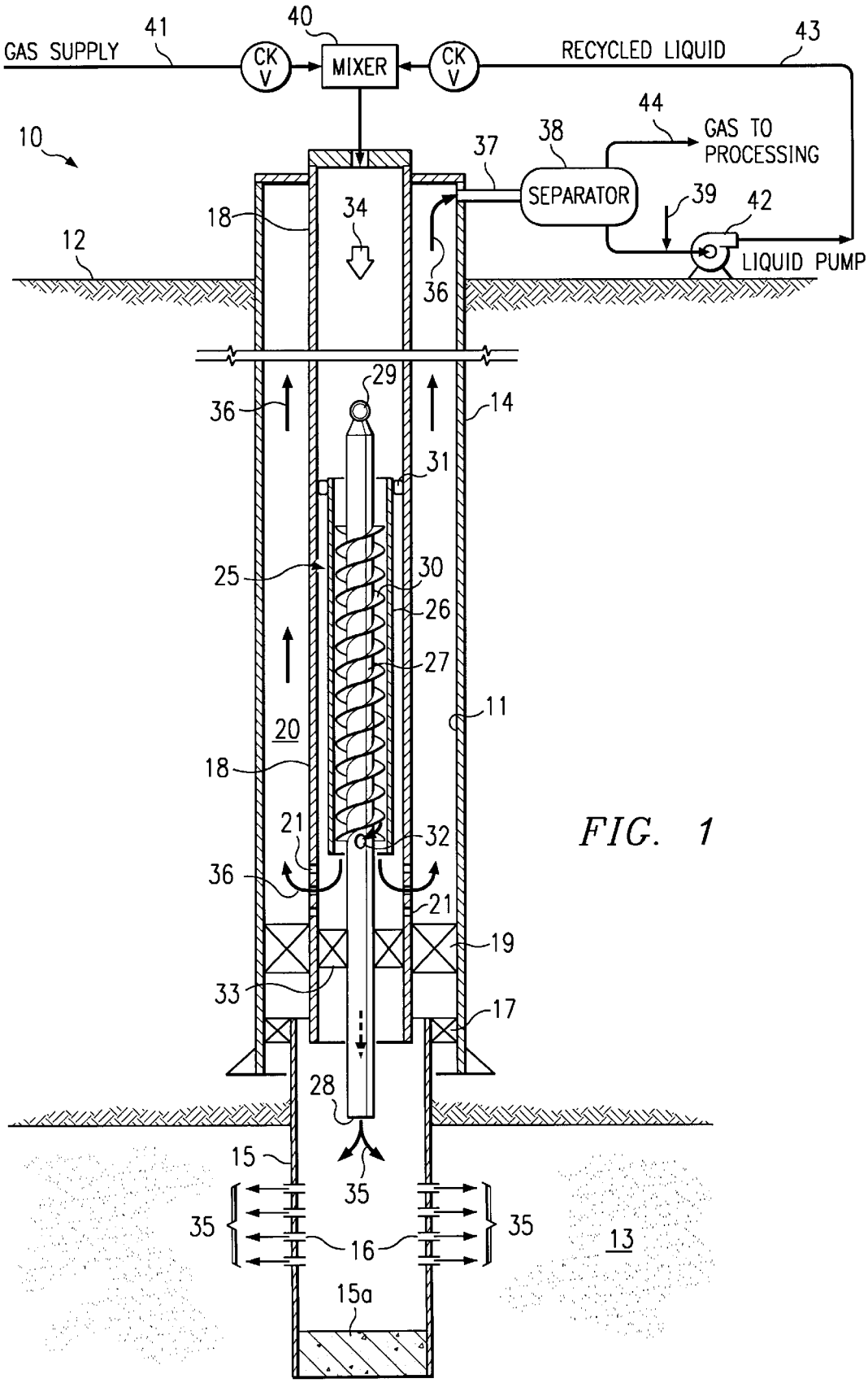
FIG. 1 illustrates a well through which gas is being injected into a subterranean formation in accordance with the present invention by flowing a carrier liquid-gas mixture down the tubing and taking returns through the well annulus.

Referring more particularly to the drawings, FIG. 1 discloses an injection well 10 having a wellbore 11 which extends from the surface 12 into a permeable subterranean formation or injection zone 13. As illustrated, wellbore 11 is cased with a string of casing 14 to a point slightly above formation 13. A liner 15 or the like having openings 16 (e.g. perforations or slots) therein and closed at its lower end by cement plug 15*a* or the like is suspended from the lower end of casing 14 and extends substantially through injection zone 13. A packer 17 is provided near the top of liner 15 to block any substantial flow from around the outside of the liner into casing 14. While this is one well-known way to complete a well, it will be recognized that other equally as well-known techniques can be used without departing from the present invention: e.g., wellbore 11 may be cased throughout it entire length and then perforated adjacent formation 13 or it may be completed "open-hole" adjacent formation 13, etc.

A string of tubing 18 is positioned within casing 14 and extends from the surface substantially throughout the length of casing 14 and terminates at a point substantially adjacent the top of injection zone 13. Packer 19 is positioned near the lower end of tubing 18 to block any flow in the annulus 20 between tubing 18 and casing 14 at that point. Tubing has at least one opening 21 (a plurality shown but only some numbered) therethrough near its lower end to provide fluid communication between the tubing 18 and annulus 20 at a point above packer 19.

A separator (e.g. auger separator 25) is positioned within tubing 18 near the lower end thereof. Separator 25 can be affixed within tubing 18 and lowered therewith or, as will be understood, it can be lowered into the tubing on a wireline, coiled-tubing, or the like (not shown) and landed on a landing nipple or the like (not shown) within the tubing after the tubing 18 has been positioned within the wellbore. Auger separator 25, as shown, is basically comprised of a housing 26 having a center conduit or tube 27 extending therethrough. Tube 27 is open at its lower end 28 and is closed at its upper end by a wireline connection 29 or the like which, in turn, can be used in positioning and/or removing separator 25 from tubing 18, as will be understood in the art.

A spiral, auger-like blade 30 is affixed to the outer surface of tube 27 and extends along a substantial portion of its length within housing 26. A seal 31 (O-ring or the like) is provided on housing 26 to effectively block flow between the housing and the tubing 18. An inlet port 32 is provided in center tube 27 below the lower end of auger blade 30 for a purpose explained below. A tubing packer 33 or an X-nipple (not shown) or the like is provided on tube 27 below port 32 to block flow through housing 26 at that point. Auger separators of this type are known in the art and are disclosed and fully discussed in U.S. Pat. No. 5,431,228 which issued Jul. 11, 1995, which, in turn, is incorporated herein in its entirety by reference.

Also, for a further discussion of the construction and operation of such separators, see "New Design for Compact-Liquid Gas Partial Separation: Down Hole and Surface Installations for Artificial Lift Applications", Jean S. Weingarten et al, SPE 30637, Presented Oct. 22–25, 1995 at Dallas, Tex. As fully disclosed and explained in the above cited references, an auger separator (i.e. separator 25) separates at least a portion of the gas from a flowing, mixed liquid-gas stream as it flows through the spiral path defined by auger blade 30. The liquid in the stream is forced to the outside of the blade and against the wall of the housing 26 by centrifugal force while at least a portion of the gas is separated from the stream and remains near the wall of the center tube 27. As the stream reaches the end of the auger, the separated gas will flow through an inlet port 32 and out the open bottom 28 of tube 27 while the liquid and remaining gas will continue to flow along the outside of tube 27, through port(s) 21, and back to the surface through well annulus 20.

Auger separators have been proposed for separating a portion of the produced gas downhole for reinjecting it into a formation before the production stream reaches the surface; see co-pending and commonly-assigned U.S. patent application Ser. No. 08/757,857, now U.S. Pat. No. 5,794,697 filed Nov. 27, 1996; Ser. No. 08/982,993, filed Dec. 2, 1997; and Ser. No. 09/016,612, filed Jan. 30, 1998. In accordance with the present invention, an auger separator 25 is used downhole in a manner which significantly reduces or substantially eliminates the expensive, compressors which would otherwise be required for injecting gas from the surface into a subterranean injection zone 13.

In accordance with the present invention, the effective density of the gas to be injected is increased at the surface before it is fed down wellbore 11. This is done by blending a dense, carrier fluid (e.g. liquid) with the gas at the surface to form a mixture having a bulk density between that of the carrier fluid and that of the gas. Dense carrier fluids which may include any fluids which will suspend the gas in the mixture but will allow separation of at least a part of the gas as the mixture passes through auger separator 25 which includes a wide variety of fluids. For example, such carrier liquids may include water; water-based liquids with added/dissolved densifying materials (e.g. produced water, seawater, drilling muds, "well-kill" brines, etc. with or without corrosion inhibitors); oil-based liquids such as drilling muds or the like; petrochemicals such as glycol; stabilized or volatile crude oils; or esoteric fluids such as a "heavy media", i.e. suspensions of fine particles of metal or the like such as a suspension of fine iron filings in water. The gas and the carrier liquid are mixed so that the density of the mixture when flowed under pressure (i.e. pumped) down wellbore 11 will overbalance the bottom-hole pressure within injection zone 13, as will be more fully discussed below.

As shown in FIG. 1, gas is supplied to mixer 40 through line 41. This is the gas which typically has been produced and then separated from a production stream (not shown) and is to be injected into subterranean zone 13. Carrier liquid from surface separator 38 (to be discussed later) and/or from a separate source 39 is pumped under pressure by pump 42 through line 43 into mixing chamber 40 or other mixing device to form a carrier liquid-gas mixture. A foaming agent (e.g. low concentrations of sulphonates, polysulphonates, long-chain alcohols) may be added to the mixture (e.g. within mixer 40) to prevent "slugging" as the mixture flows downward in tubing 18 as will be understood in the art.

This mixture (arrows 34) flows down tubing 18 (FIG. 1) and through auger separator 25 where centrifugal force separates at least a portion of the gas from the mixture as explained above. The separated gas (arrows 35 in FIG. 1) passes through port(s) 32 in central tube 27 and exits into liner 15. Packers 17, 19, and 33 block any substantially upward flow of gas so it can only flow through openings 16 and into zone 13 as the gas accumulates and the pressure increases in within liner 15.

The dense carrier liquid plus any remaining gas mixture (arrows 36 in FIG. 1) flows along the outside of blade 30 of separator 25 and will pass through port(s) 21 in housing 26 as it reaches the bottom of blade 30. The carrier liquid-unseparated gas mixture will flow to the surface through well annulus 20, through outlet 37, and into surface separator 38 where the remaining gas is separated from the carrier liquid. Any separated gas is taken from separator 38 through line 44 to be used as fuel or otherwise properly disposed of. The carrier liquid is taken from separator 38 and is preferably recycled to mixer 40 through pump 42 to be reused in the ongoing gas injection operation. It should be understood that carrier liquid may be added or removed from the circuit through line 39 as a particular situation may dictate.

In order to inject gas into zone 13, the pressure of the separated gas in liner 15 has to be greater than the pressure within zone 13. Accordingly, the pressure of the carrier liquid-gas mixture at the surface must be sufficient to overbalance the well pressure thereby allowing the mixture to flow down the wellbore 11. This pressure is dictated by the pressure of the gas supply. Given that pumping liquid is easier than compressing gas, the pressure of the liquid in line 43 is substantially matched to the available gas pressure. The liquid pressure is generated at the surface primarily by pump 42 as it pumps the carrier-liquid to mixer 40. By generating the necessary injection pressure through the pumping of liquid, gas compression is substantially reduced or eliminated thereby significantly reducing the costs involved in the gas injection operation.

To further illustrate the present invention, an idealized example of a typical injection operation will now be set forth. Gas is to be injected into a injection zone 13 which has a formation pressure of approximately 3500 psia. Gas is fed to mixer 40 at a rate of 26.7 standard million cubic feet per day at a pressure of approximately 1950 psia while carrier liquid (e.g. water) is pumped into mixer 40 at a rate of 12000 bbls. per day at a pressure of approximately 1950 psia. A carrier-gas mixture having a density of about 21.6 lbs./cu.ft. leaves mixer 40 at a pressure of about 1950 psia and flows down wellbore 11. As the mixture flows through auger separator 25, approximately 75% of the gas will be separated from the mixture and will flow into liner 15 at a pressure of about 3730 psia. Since this pressure is greater than the formation pressure in zone 13, the gas will enter the zone, as is understood in the art. The differential in pressure between that of the mixture 36 as it enters the base of annulus 20 and the pressure at outlet 37 of annulus 20 causes the carrier liquid-unseparated gas mixture 36 to flow back to the surface. The unseparated gas expands as the mixture passes up annulus 20 thus assisting the lifting of the liquids.

Figure 2:
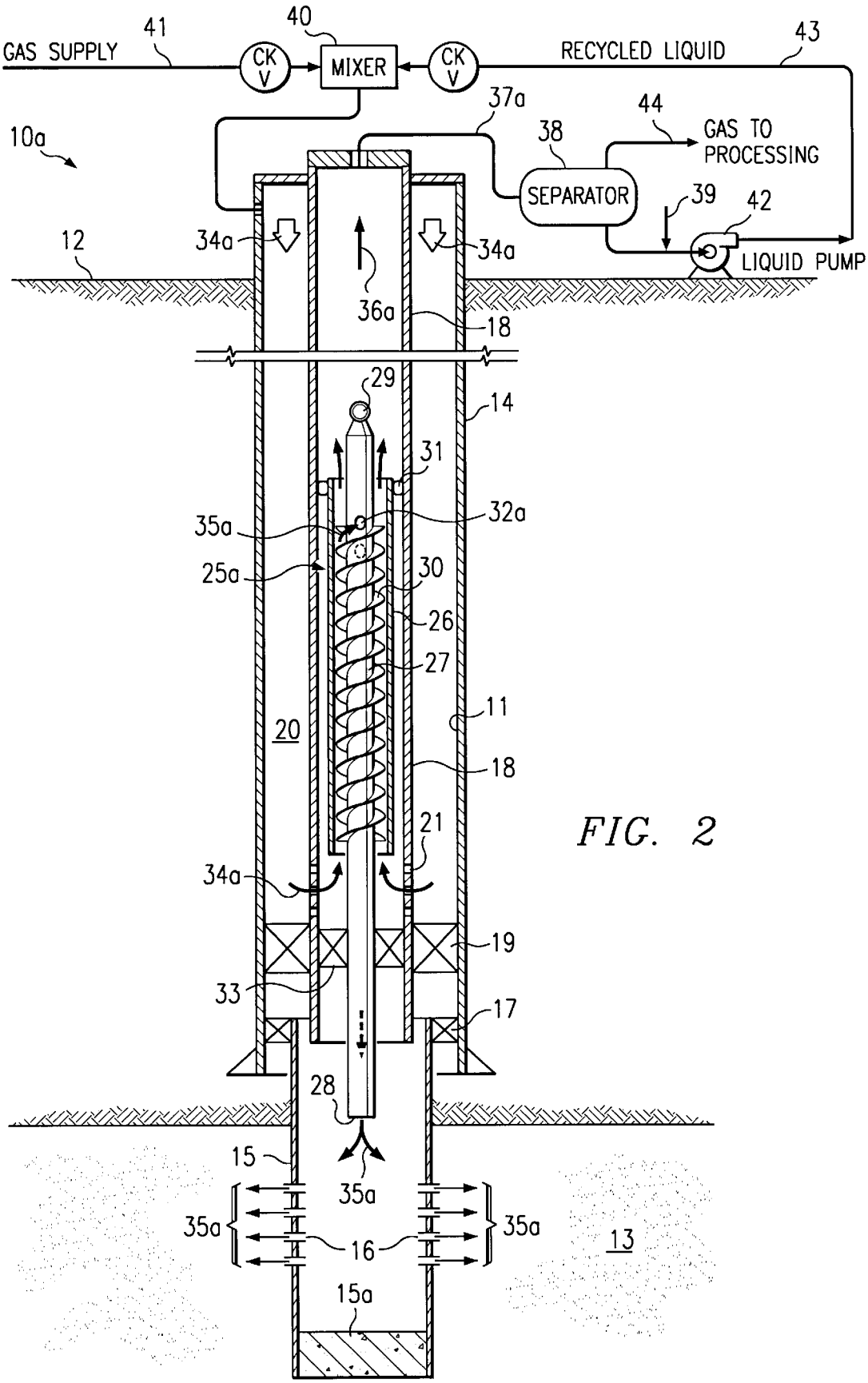
FIG. 2 illustrates a well through which gas is being injected into a subterranean formation in accordance with the present invention by flowing a carrier liquid-gas mixture down the well annulus and taking returns through the tubing.

FIG. 2 illustrates a further embodiment of the present invention wherein the flowpath is reversed. Well 10*a* is completed in the same manner as is well 10 in FIG. 1. The gas which is to be injected is mixed with a carrier liquid in mixer 40 in the same manner as described above. However, mixture 34*a* is now fed down well annulus 20 and through opening(s) 21 in tubing 18 to then flow upward through auger separator 25*a*. Again, at least a portion of the gas in mixture 34*a* will separate out of the mixture due to centrifugal force and will flow through opening(s) 32*a* which is now positioned above the top of blade 30 while the remainder 36*a* of mixture 34*a* flows to the surface through tubing 18 and out outlet 37*a* to separator 38. Separated gas 35*a* flows down center tube 27 and out the bottom thereof into liner 15 from which it passes through openings 16 into injection zone 13. Again, since the necessary injection pressure is effectively supplied by the supply gas and the pumped carrier liquid, the gas compression requirement at the surface is significantly reduced or eliminated.

What is claimed is:

1. A method for injecting a gas into a subterranean formation comprising:

mixing said gas with a carrier fluid at the surface to form a mixture therewith;

flowing said mixture down a wellbore which extends from the surface into said subterranean formation;

separating at least a portion of said gas from said mixture after said mixture has flowed down said wellbore;

injecting said separated portion of said gas into said subterranean formation; and returning the mixture of said carrier fluid and any unseparated gas to said surface.

2. The method of claim 1 wherein said carrier fluid is comprised of water.

3. The method of claim 1 wherein said carrier fluid is comprised of brine.

4. The method of claim 1 wherein said carrier fluid is comprised of oil-based liquids.

5. The method of claim 1 wherein said carrier fluid is comprised of crude oil.

6. The method of claim 1 wherein said carrier fluid is comprised of a petrochemical liquid.

7. The method of claim 1 including;

separating said unseparated gas from carrier fluid after said mixture is returned to the surface; and recycling said separated carrier fluid for mixing with said gas to be injected.

8. In a well having a wellbore extending from the surface into a subterranean formation and having a string of tubing extending within said wellbore with a downhole separator positioned within said tubing at a point substantially adjacent the top of said subterranean formation, a method of injecting gas into said subterranean formation comprising:

mixing said gas with a carrier fluid at the surface to form a mixture therewith;

flowing said mixture through said separator within said tubing to thereby separate at least a portion of said gas from said mixture;

injecting said separated portion of said gas into said subterranean formation; and returning the mixture of said carrier fluid and any unseparated gas to said surface.

9. The method of claim 8 wherein said carrier liquid is selected from the group of water, brine, oil-based liquids, crudes, petrochemicals, and heavy media.

10. The method of claim 8 wherein said separator is an auger separator.

11. The method of claim 8 wherein said mixture is flowed down said tubing and through said separator and said mixture of said carrier fluid and any unseparated gas is returned to the surface through the annulus which is formed between said tubing and said wellbore.

12. The method of claim 8 wherein said mixture is flowed down said through the annulus which is formed between said tubing and said wellbore and up through said separator and said mixture of said carrier fluid and any unseparated gas is returned to the surface through said tubing.

13. The method of claim 8 including;

separating said unseparated gas from carrier fluid after said mixture is returned to the surface; and recycling said separated carrier fluid for mixing with said gas to be injected.

14. Apparatus for injecting gas into a subterranean formation, said apparatus comprising:

a well having a wellbore extending from the surface into said subterranean formation;

a string of tubing positioned within said wellbore and extending from said surface to a point substantially adjacent said subterranean formation wherein an annulus is formed between said tubing and said wellbore;

a separator positioned with said tubing near the lower end thereof;

a mixer for mixing said gas with a carrier fluid at the surface to form a mixture thereof;

means for flowing said mixture down through said wellbore and through said separator to thereby separate at least a portion of said gas from said mixture;

means for flowing said separated portion of said gas from said separator into said subterranean formation; and means for flowing the mixture of said carrier fluid and any unseparated gas back to the surface.

15. The apparatus of claim 14 wherein said separator is an auger separator.

16. The apparatus of claim 15 wherein said means for flowing said mixture down through said wellbore comprises:

said string of tubing;

and wherein said means for flowing said mixture of said carrier and said any unseparated gas comprises:

said annulus between said tubing and said wellbore.

17. The apparatus of claim 15 wherein said means for flowing said mixture down through said wellbore comprises:

said annulus between said tubing and said wellbore;

and wherein said means for flowing said mixture of said carrier and said any unseparated gas comprises:

said string of tubing.

18. The apparatus of claim 15 including:

a separator at the surface for separating said unseparated gas from said mixture of said carrier fluid and any unseparated gas after said mixture is returned to the surface.

* * * * *